United States Patent [19]

Ishida

[11] 4,121,932

[45] Oct. 24, 1978

[54] ELECTROPHOTOGRAPHIC PROCESS INVOLVING DYE TRANSFER IMAGEWISE

[75] Inventor: Eisuke Ishida, Nara, Japan

[73] Assignee: Matsushita Electric Industrial Co., Ltd., Japan

[21] Appl. No.: 785,125

[22] Filed: Apr. 6, 1977

Related U.S. Application Data

[63] Continuation-in-part of Ser. No. 614,414, Sep. 18, 1975, abandoned.

[30] Foreign Application Priority Data

| | | | |
|---|---|---|---|
| Sep. 28, 1974 | [JP] | Japan | 49-111957 |
| Sep. 28, 1974 | [JP] | Japan | 49-111958 |
| Jun. 2, 1975 | [JP] | Japan | 50-66831 |

[51] Int. Cl.[2] ..... G03G 13/01; G03G 13/30

[52] U.S. Cl. ..... 96/1.2; 96/1 R; 96/1.4; 427/145; 427/150; 427/151; 101/470; 101/472; 101/DIG. 13; 427/22; 427/24; 252/62.1 P

[58] Field of Search ..... 96/1 R, 1.2, 1.4; 427/144, 145, 150, 151; 101/470, 472; 8/2.5 A

[56] References Cited

U.S. PATENT DOCUMENTS

| | | | |
|---|---|---|---|
| 3,013,878 | 12/1961 | Dessauer | 96/1.4 X |
| 3,210,544 | 10/1965 | Marx et al. | 8/2.5 A X |
| 3,280,735 | 10/1966 | Clark et al. | 101/470 X |
| 3,309,991 | 3/1967 | Hayon et al. | 101/472 X |
| 3,329,590 | 7/1967 | Renfrew | 96/1.2 X |
| 3,357,353 | 12/1967 | Tenscher | 101/470 X |
| 3,386,822 | 6/1968 | Brynko | 96/1.4 |
| 3,511,650 | 5/1970 | Shely et al. | 101/470 X |
| 3,609,360 | 9/1971 | Wiese | 8/2.5 A X |
| 3,630,729 | 12/1971 | Bach et al. | 96/1.2 |
| 3,632,291 | 1/1972 | Defago et al. | 101/470 X |
| 3,681,065 | 8/1972 | Sato et al. | 96/1.2 |
| 3,754,907 | 8/1973 | Chapin | 96/1.2 X |
| 3,772,053 | 11/1973 | Eastman et al. | 96/1.2 X |
| 3,879,196 | 4/1975 | Nagashima et al. | 96/1.2 |
| 3,900,318 | 8/1975 | Zograpnos et al. | 96/1.2 X |

*Primary Examiner*—Roland E. Martin, Jr.
*Attorney, Agent, or Firm*—Burgess, Ryan and Wayne

[57] ABSTRACT

An electrophotographic process of forming a dye image comprising the steps of:

(1) charging a photosensitive element formed on an electroconductive support by electrical charging, said photosensitive element consisting essentially of photoconductive particles and sublimable dyes, (2) exposing the charged photosensitive element to a light image, (3) developing the photosensitive element with acidic toners, (4) heating the photosensitive element to sublime the sublimable dyes, and (5) transferring the dye images to a dye-image accepting substrate with the aid of solvents.

An electrophotographic material comprising an electroconductive support and a photosensitive element (i.e., photoconductive layer) formed thereon, said photosensitive element consisting essentially of photoconductive powders and sublimable dyes.

7 Claims, 2 Drawing Figures

ELECTROPHOTOGRAPHIC PROCESS INVOLVING DYE TRANSFER IMAGEWISE

CROSS-REFERENCE TO RELATED APPLICATION

This application is a continuation-in-part of copending application Ser. No. 614,414, filed Sept. 18, 1975, now abandoned.

BACKGROUND OF THE INVENTION

An electrophotographic material comprises a electroconductive support and a photosensitive element (i.e., photoconductive layer) formed thereon. The principle of an electrophotographic process in the black and white reproduction field is that an electrostatic latent image is formed by exposure of a charged photosensitive element to a light image and the image is then developed by a fine powder, called the toner, which is electrically deposited on the latent image to form a visible black image.

In the present invention, sublimable dyes or sublimable leuco dyes are contained in a photosensitive element (a photoconductive layer), and a unicolored dye image or a multicolored dye image is formed on the photosensitive element. Alternatively, a reversed unicolored or multicolored dye image may be formed on a surface of another substrate by subliming the sublimable dyes and capturing the sublimed dye on the substrate containing the acid substance.

SUMMARY OF THE INVENTION

The present invention relates to an electrophotographic process of forming a dye image and electrophotographic materials for use in the electrophotographic process.

An electrophotographic material of this invention has a photosensitive element (i.e., photoconductive layer) on an electroconductive support, said photosensitive element consisting essentially of photoconductive powders (powders of photoconductors) and sublimable dyes. Said sublimable dyes may be sublimable leuco dyes. This electrophotographic material is used for obtaining a unicolored dye image.

Another electrophotographic material of this invention has a photosensitive element (i.e., photoconductive layer) on an electroconductive support, said photosensitive element consisting essentialy of photoconductive powders (powders of photoconductors), sensitizers and sublimable dyes, Said sublimable dyes may be sublimable leuco dyes. This electrophotographic material containing sensitizers is used for obtaining a multicolored dye image.

An electrophotographic material for forming a unicolored dye image may be prepared as follows:

A dispersion is obtained by mixing a photoconductive powder (powder of photoconductor), a sublimable dye (or a sublimable leuco dye), a binder and an organic solvent in a ball mill. The dispersion is applied to a surface of an electroconductive support and then dried.

An electrophotographic material for forming a multicolored dye image may be prepared as follows:

A dispersion is obtained by mixing a photoconductive powder (powder of photoconductor), a sensitizer, a sublimable dye (or a sublimable leuco dye), a binder and an organic solvent.

Three kinds of dispersions for yellow, magenta and cyan colors are prepared by using three kinds of sensitizers and sublimable dyes. Three kinds of color-producing photosensitive particles having particle sizes of 10 to 100 microns are obtained by spraying the dispersions under a pressure of nitrogen gas by means of a spray gun. A mixture of three kinds of color-producing photosensitive particles is distributed on a surface of a charged polyester film, and electroconductive paper is laid on the surface of the polyester film. The laminated material thus obtained is passed through a calender at an elevated temperature, and then the polyester film is peeled off from the paper to obtain an electrophotographic material for color processing having a photosensitive element on the paper.

In this invention, the following photoconductors in powder form may be used:

Inorganic photoconductors such as zinc oxide, cadmium sulfide, zinc sulfide and selenium; organic photoconductors such as polyvinylanthracene, 9, 10-dimethylanthracene, other anthracene derivatives, N-ethylcarbazole, 9, 10-dibromo-N-ethylcarbaxole, poly-N-vinylcarbazole, other carbazole derivatives, pyrazolone derivatives, naphthalene derivatives, pyrene, pyrene derivatives and the reaction product of 9, 10-dichloromethylanthracene and N-ethylcarbazole.

The following sublimable dyes and sublimable leuco dyes may be used:

Yellow (or orange) color-producing dye:
- Sublimable dye: diphenylamine, 1,3-dinitro-3'hydroxydiphenylamine, 1-amino-2-methlanthraquinone;
- Sublimable leuco dye: 4 , 4'- dimethylaminodiphenyl ketone;

Magenta color-producing dye:
- Sublimable dye: 1-amino-2-methoxy-4-hydroxyanthraquinone, 1, 4-diamino-2-methoxyanthraquinone, 3-nitropheynlazo-3'-aminobenzene, 1-methyl-3-amino- 4-methoxy phenylazo-3'-aminobenzene;
- Sublimable leuco dye: 3, 4, 8, 9,-tetradimethylaminophenazine.

Cyan (or blue) color-producing dye:
- Sublimable dye: Malachite Green, 1, 4, 5, 8-tetraaminoanthraquinone, 1-methylamino- 4-ethanolaminoanthraquinone;
- Sublimable leuco dye: 4, 4'-dimethylaminodiphenylethylene;

Such sublimable dyes or sublimable leuco dyes are used in an amount of 0.5 to 15%, preferably 1 to 5% by weight, based on the amount of photoconductive powders.

The sensitizers added to the photoconductive powders are as follows:

Blue sensitizer (sensitizer absorbing blue-violet light):
- Uramine, Fluorescein, Tartrazine, 3-carboxymethyl-5-(3-ethyl-2(3-benzthiazolidene)-rhodanine-triethylamine salt, Auramine and Seto-flavine T.

Green sensitizer (sensitizer absorbing green light):
- Rose Bengale, Eosine, Erythrosine, Fuchsine, Pyronine B, Rhodamine G, Violanin, Methyl Violet, Neutral Red and Astrophloxine. Red sensitizer (sensitizer absorbing red light):
- Diacid Cyanine Green GWA, Methylene Blue, Patent Blue V, Victoria Blue B, Xylene Cyanol FF and Brilliant Blue A.

Quinones and nitrated quinones also may be used as a sensitizer.

Such sensitizers are added in an amount of 0.0001 to 0% by weight, based on the amount of photoconductive powders.

As a binder, the following organic high molecular compounds may be used:

Acrylic resin, vinyl chloride resin, vinyl acetate resin, vinyl chloride-vinyl acetate copolymer, styrene-butadiene copolymer, styrene resin, slicone resin, epoxy-silicone resin, alkyd resin, epoxy resin, phenol resin, maleic acid resin and wax.

The binder is used in an amount of 5 to 40% by weight based on the amount of photoconductive powders.

As an organic solvent, the following solvents may be used:

Alcohols such as methanol and ethanol; ketones such as acetone and methyl ethyl ketone; aromatic hydrocarbons such as benzene, toluene and xylene halogenated hydrocarbons such as ethylene choloride and trichloroethylene; and tetrahydrofuran.

As an electroconductive support, high quality paper coated with a high molecular quaternary ammonium salt, electroconductive plastic film, aluminium-coated paper and metal sheet may be used.

The present invention is based on the principal as described below:

(1) Sublimable dyes can be sublimed by heating at a temperature of 80° C to 200° C.

(2) Sublimable dyes are captured by acid substances.

(3) Sublimable dyes captured by acid substances become difficult to sublime.

(4) Sublimable colorless leuco dyes produce color by contacting with acid substances.

As the acid substance, the following organic acids and inorganic substance may be used:

Oxalic acid, tartaric acid, trichloracetic acid, citric acid, maleic acid, fumaric acid, citraconic acid, suberic acid, maleic acid, behenic acid, ascorbic acid, phenylacetic acid, salicylic acid, gallic acid, picric acid, polyparaphenyphenol and activated clay.

Acidic toners are prepared by mixing and pulverizing an acid substance and a resin such as polyaminostyrene, dimethylaminostyrene, diethylaminostyrene, polyvinylpyrrolidone, alkyd resin, or phenolformaldehyde resin.

Developers in powder form or liquid form are prepared by mixing the toners with iron powders or by dispersing the toners in hydrocarbons. In this way, the positively or negatively charged toners can be obtained.

The process of the present invention for forming a unicolored dye image will be illustrated below:

In this case, zinc oxide is used as a photoconductive powder, and as previously described, an electrophotographic material is prepared.

The photosensitive element is negatively charged by conventional electrical charging such as corona discharge and then exposed image-wise to light to form an electrostatic latent image on the photosensitive element. Acidic toners are deposited on the latent image by developing with a developer containing positively charged toners, and then heating the photosensitive element, for example, at a temperature of 170° C, and the sublimed dye is captured on a surface of an acidic toner on the photosensitive element. The dye image is then transferred to a dye image-accepting substrate with the aid of a solvent. In this way, a positive-to-positive reversed dye image is formed on the surface of the dye image-accepting substrate.

In the procedure as shown above, when negatively charged toners are used instead of positively charged toners, a positive-to-negative reversed dye image can be obtained on the surface of the dye image-accepting substrate.

As the dye image-accepting substrate, a transparent substrate may be used.

The dye process of the present invention for forming a multi-color dye image will be illustrated below:

In this case, zinc oxide is used as a photoconductive powder, and as previously described, an electrophotographic material is prepared.

Three kinds of color-producing photosensitive particles B, G and R consist of the following:

Particle B consists of a photoconductive powder, a sensitizer absorbing blue-violet and a sublimable yellow color dye. A sublimable leuco dye producing yellow color may be used instead of the sublimable yellow color dye.

Particle G consists of a photoconductive powder, a sensitizer absorbing green light and a sublimable magenta color dye.

A sublimable leuco producing magenta color may be used instead of the sublimable magenta color dye.

Particle R consists of a photoconductive powder, a sensitizer absorbing red light and a sublimable cyan color dye. A sublimable leuco dye producing cyan color may be used instead of the sublimable cyan color dye.

When color-producing photosensitive particles B, G and R are charged by corona discharge and exposed to light, particles B, G and R, respectively, absorb blue-violet, green and red lights to dissipate the electric charge.

On referring to the accompanying drawings, FIG. 1, an electrophotographic material comprises an electroconductive support and a photosensitive element (a photoconductive layer) formed on the support, the photosensitive element consisting of color-producing photosensitive particles B, G and R disposed at random on the support. When the photosensitive element is negatively charged by corona discharge and then exposed to blue-violet, green and red lights, electrical charges of Particles B, G and R dissipate or remain as follows and electrostatic latent images are formed on the photosensitive element:

In the region (B) irradiated by blue-violet light, the electric charge of Particle B dissipates and electric charges of Particles G and R remain.

In the region (G) irradiated by green light, the electric charge of Particle G dissipates and electric charges of Particles B and R remain.

In the region (R) irradiated by red light, the electric charge of Particle R dissipates and electric charges of Particle B and G remain.

In the non-irradiated region, all electric charges of Particles B, G and R remain.

In the region irradiated by white light, all electric charges of Particles B, G and R dissipate.

Toners are deposited on the latent image by developing with a developer containing positively charged toners as follows:

In the region irradiated by blue-violet light, toners are deposited on Particles G and R. In the region irradiated by green light, toners are deposited on Particles B and R. In the region irradiated by red light, toners are desposited on Particles B and G. In the non-irradiated region, toners are deposited on Particles B , G and R.

The photosensitive element is heated, for example, at a temperature of 170° C, and sublimed dye is captured on the toners.

In this way, a positive-to-positive color dye image is formed on the photosensitive element as, magenta color dye in Particle G and cyan color dye in Particle R produce blue color; yellow color dye in Particle B and cyan color dye in Particle R produce green color; and yellow color dye in Particle B and magenta color dye in Particle G produce red color. A positive-to-positive or a positive-to-negative dye image can be obtained on a support by transferring it to a substrate such as paper as follows:

On referring to Fig. 2, the positive-to-positive color image obtained above can be transferred to a surface of paper with the aid of a solvent such as water or organic solvents. For example, paper wetted by water is laid on the photosensitive element having the dye image formed and then the paper is peeled off from the photosensitive element.

Said organic solvents include alcohols such as methyl alcohol and ethyl alcohol, ketones such as acetone and methyl ethyl ketone, tetrahydrofuran and other hydrocarbons.

The present invention has been illustrated above by using three kinds of color-producing photosensitive particles. However, it should be understood that two-kinds of color-producing photo-sensitive particles may also optionally be used.

Further, a combination of a sensitizer and a sublimable dye may optionally be selected to obtain colors other than those as shown above.

DESCRIPTION OF THE PREFERRED EMBODIMENTS

Figure 1:
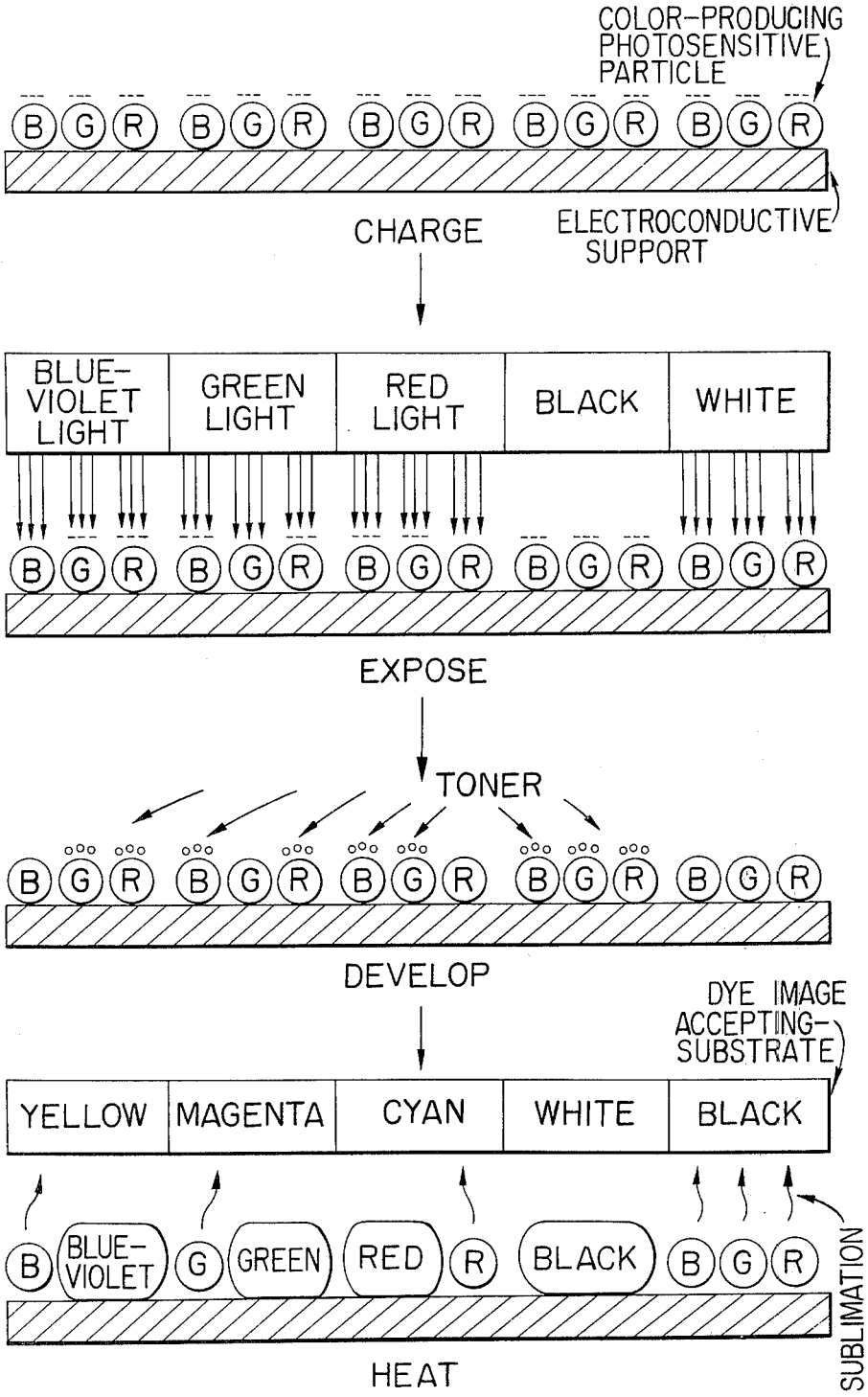
Figure 2:
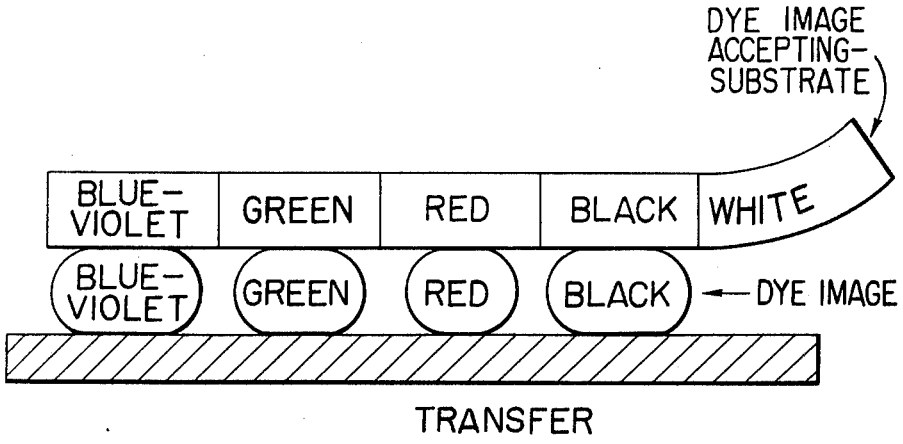

The following examples are given by way of illustration only and are not intended as limitations of this invention.

EXAMPLE I

A dispersion was prepared by mixng 200g of zinc oxide, 6g of 1-amino-2-methylanthraquinone (sublimable yellow dye), 30g of acrylic resin and 200g of toluene in a ball mill. The dispersion was applied to a surface of an aluminum film of an aluminum-coated paper by means of a wire bar to obtain an electrophotographic material having a photosensitive element of 15 microns in thickness.

Polyaminostyrene was pulverized to obtain fine powders (toners) having a partivle size of 5 microns. The powders (powdered polyaminostyrene) were mixed with iron powders to obtain a developer in powder form. The toners were positively charged.

The electrophotographic material obtained above was negatively charged using a conventional corona discharge of −6kV and it was then exposed to light while in contact with an image original, and it was developed with the developer prepared above by using a magnetic brush. The toners were fixed to the image area of the photosensitive element by heating at a temperature of 120° C to form a positive-to-positive white image on the photosensitive element. Paper carrying activated caly was laid on the photosensitive element and then the photosensitive element was heated at a temperature of 170° C for 30 seconds. A positivie-to-negative reversed yellow dye image was formed on the paper by sublimation of 1-amino-2-methylanthraquinone.

EXAMPLE 2

Phenol-formaldelyde resin (sold by Arakawa Rinsan Kagakukogyo K.K. under the trademark of Tamanol PA) was pulverized to obtain fine powders (toners) having a particle size of about 5 microns. The powders were mixed with hydrocarbon (sold by Shell Chemicals Co. under the trademark I sopar H) and then dispersed in a ball mill to obtain a dispersion containing powders having a particle size of about 1 micron. The powders were negatively charged.

The same procedure as that of Example 1 was repeated by utilizing an electrophotographic material prepared in Example 1 except that the dispersion obtained above was used as a developer instead of the developer prepared in Example 1. The toners were deposited in the non-image area of the photosensitive element to form a positive-to-negative white image.

A positive-to-positive reversed yellow dye image formed on the paper carrying activated clay by repeating the procedure as shown in Example 1.

EXAMPLE 3

A mixture of 300g of tartaric acid and 150g of polyparadimethylaminostyrene was dissolved in 500g of methanol. After the resulting solution dried, the residue was pulverized by a jet mill to obtain fine powders (toners) having a particle size of about 5 microns. The powders were mixed with iron powders to obtain a developer in powder form. The toners were positively charged.

The same procedure as that of Example 1 was repeated by utilizing and electrophotographic material prepared in Example 1 except that the developer obtained above and phenol resin (polyaparaphenylphenol resin)-coated paper were used instead of the developer prepared in Example 1 and paper carrying activated clay.

A positive-to-negative yellow dye image similar to that of Example 1 was formed on the paper.

EXAMPLE 4

A dispersion was prepared by mixing 200g zinc oxide, 7g of bis (4, 4'-di-paradimethylaminodiphenyl ethylene and 200g of toluene in a ball mill. The dispersion was applied to a surface of an aluminum film of an aluminum-coated paper to obtain an electrophotographic material having a photosensitive element of 15 microns in thickness.

The photosensitive element was charged and exposed as described in Example 1 and then developed by using the developer prepared in Example 3 and heated at a temperature of 130° C for 30 seconds. In this way, a positive-to-positive cyan-color dye image was formed on the photosensitive element.

A dye image-accepting substrate was prepared by applying a mixture of 400g of titanium oxide, 30g of gelatin, 600g of water and 5g of formaldehyde to a surface of white paper and drying so as to have a surface layer of about 10 microns in thickness. The substrate which has been wetted by water, was laid on the photosensitive element carrying the cyan-color dye image. The cyan-color dye image was transferred from the photosensitive element to the substrate. The substrate carrying a positive-to-positive reversed cyan-color dye image was obtained.

EXAMPLE 5

A suspension was prepared by mixing 600g of zinc oxide, 90g of acrylic resin and 600g of toluene in a ball mill. The suspension was divided into three parts. Dispersions B, G and R were prepared by mixing a sensitizer and a sublimable dye with the suspension as follows:

Dispersion B:

| | |
|---|---|
| Auramine (blue sensitizer) | 0.02g |
| 1, 3-dinitro-3'-hydroxydiphenylamine (sublimable yellow color dye) | 5g |
| Suspension prepared above | 430g |

Dispersion G:

| | |
|---|---|
| Rose Bengale (green sensitizer) | 0.005g |
| 3-nitrophenylazo-3'-aminobenzene (sublimable magenta color dye) | 6g |
| Suspension prepared above | 430g |

Dispersion R:

| | |
|---|---|
| Crystal Violet (red sensitizer) | 0.03g |
| Malachite Green (sublimable cyan color dye) | 4g |
| Suspension prepared above | 430g |

Color-producing photosensitive particles B, G and R having a particle size of 30 to 40 microns were obtained by spraying Dispersion B, G and R under a pressure of 2 kg/cm² of nitrogen gas by means of a spray gun in an atomosphere having a temperature of 25° C, respectively. A mixture of Particles B, G and R was distributed on a surface of a charged polyester film, and electroconductive paper having a thickness of 70 microns was laid on the surface of the polyester film. The laminated material thus obtained was passed through a calender at a temperature of 70° C and a pressure of 7kg/cm, and then the polyester film was peeled off from the paper to obtain an electrophotographic material (A) for color process carrying a photosensitive element on the paper.

Properties of Electrophotographic material (A) are shown below:

Acceptance potential (Vo): −350V

Retentivity after 60 seconds: (V60 /Vo × 100): 60%

Photographic sensitivity (E10)*: 100 lux.sec

*E10: The exposure required to reduce the surface electric potential to one tenth of its original value.

The electrophotographic material (A) obtained above was negatively charged using a conventional corona discharge of −6kV and then it was exposed to light while in contact with an color (blue, green and red) image original, and it was developed with the developer prepared in Example 1 by using magnetic brush. The toners were fixed to the image of the photosensitive element by heating at a temperature of 120° C to form a positive white image on the photosensitive element. Paper (B) carrying activated clay was laid on the photosensitive element and then the photosensitive element was heated at a temperature of 170° C for 30 seconds. In this way, a positive-to-negative reversed dye image having complementary colors (yellow, magenta and cyan) was formed on the paper (B).

EXAMPLE 6

Electrophotographic material (A) prepared in Example 5 was developed by repeating the same procedure as that of Example 5 except that the developer prepared in Example 3 was used instead of the developer prepared in Example 1, and then heated at a temperature of 130° C for 30 seconds to form a positive-to-positive color image on the light-sensitvie material. This color image was transferred to the dye image-accepting substrate prepared in Example 4 by repeating the same procedure as described in Example 4. In this way, a positive-to-positive reversed color image was formed on the substrate.

EXAMPLE 7

A suspension was prepared by mixing 1200g of zinc oxide, 120g of acrylic resin and 1000g of toluene in a ball mill. The suspension was divided into three parts. Dispersions $B_1$, $G_1$ and $R_1$ were prepared by mixing a sensitizer and a sublimable leuco dye with the suspension as follows:

Dispersion $B_1$:

| | |
|---|---|
| Auramine (blue sensitizer): | 0.04g |
| 4, 4'-tetradimethylaminodiphenyl ketone (sublimable leuco dye producing yellow color): | 12g |
| Suspension prepared above: | 770g |

Dispersion $G_1$:

| | |
|---|---|
| Rose Bengale (green sensitizer) | 0.01g |
| 3, 4, 8, 9-tetradimethylaminophenazine (sublimable leuco dye producing magenta color) | 12g |
| Suspension prepared above: | 770g |

Dispersion $R_1$:

| | |
|---|---|
| Diacid Cyanine Green GWA (red sensitizer): | 0.06g |
| 4, 4'-dimethylaminodiphenylethylene | 12g (sublimable leuco dye producing cyan color): |
| Suspension prepared above | 770g |

Color-producing photosensitive particles B, G, and R, having a particle size of 30 to 44 microns were obtained by spraying Dispersion $B_1$, $G_1$ and $R_1$ under a pressure of 2kg/cm² of nitrogen gas by means of a spray gun in an atmosphere of a temperature of 25° C, respectively. A mixture of Particles $B_1$, $G_1$ and $R_1$ was distributed on a surface of a charged polyester film, and electroconductive paper having a thickness of 70 microns was laid on the surface of the polyester film. The laminated material thus obtained was passed through a calender at a temperature of 70° C and a pressure of 7kg/cm, and then the polyester film was peeled off from the paper to obtain an electrophotographic material ($A_1$) for color process carrying a photo-sensitive element on the paper.

Properties of Electrophotographic material $A_1$ are shown below:

Acceptance potential (Vo): −350V

Retentivity after 60 seconds: $V_{60}$/Vo × 100): 70%

Photographic sensitivity ($E_{10}$): 80 lux.sec

The electrophotographic material ($A_1$) obtained above was negatively charged using a conventional corona discharge of −6kV and then it was exposed to light while in contact with a color (blue, green and red) image original, and it was developed with the developer prepared in Example 3 and heated at a temperature of 130° C for 30 seconds to fix the toners to the image area of the photosensitive element. In this way, a positive-to-positive color dye image was formed on the photosensitive element.

Further, after heating the photosensitive element at a temperature of 130° C as shown above, a dye image-accepting substrate prepared in Example 4 was laid on the photosensitive element carrying a positive-to-positive color image, as shown in Example 4. The positive-to-positive color dye image was transferred from the photosensitive element to the substrate. The substrate carrying a positive-to-positive reversed color image was obtained.

What is claimed is:

1. An electrophotographic process of forming a dye image comprising the steps of: (1) charging a photosensitive element formed on an electroconductive support by electrical charging, said photosensitive element consisting essentially of a mixture of photoconductive powders and sublimable dyes, (2) exposing the charged photosensitive element to a light image to form an electrostatic latent image, (3) developing the photosensitive element with an acidic toner, (4) heating the photosensitive element to form a dye image, and (5) transferring the dye image to a dye image-accepting substrate with the aid of a solvent.

2. An electrophotographic process according to claim 1 wherein sublimable dyes are sublimable leuco dyes.

3. An electrophotographic process according to claim 1 wherein the dye image-accepting substrate contains a solvent which can dissolve the dye.

4. An electrophotographic process according to claim 3 wherein the solvent is water or a solvent soluble in water.

5. An electrophotographic process according to claim 1 wherein the photosensitive element comprises at least two kinds of color-producing photosensitive particles, said color-producing photosensitive particles consisting essentially of a photoconductive powder, 0.0001 to 2 percent by weight of a sensitizer and 0.5 to 15 percent by weight of a sublimable dye, said percentages being based on the amount of photoconductive powder.

6. An electrophotographic process according to claim 1 wherein the photosensitive element comprises three kinds of color-producing photosensitive particles, said color-producing photoconductive particles consisting of:

(1) color-producing photosensitive particles consisting essentially of a photoconductive powder, 0.0001 to 2 percent by weight of a sensitizer absorbing blue-violet light and 0.5 to 15 percent by weight of a sublimable yellow color dye, (2) color-producing photosensitive particles consisting essentially of a photoconductive powder, 0.0001 to 2 percent by weight of a sensitizer absorbing green light and 0.5 to 15 percent by weight of a sublimable magenta color dye, and (3) color-producing photosensitive particles consisting essentially of a photoconductive powder, 0.0001 to 2 percent by weight of a sensitizer absorbing red light and 0.5 to 2% by weight of a sublimable cyan color dye, (4) said percentages being based on the amount of the respective photoconductive powders.

7. An electrophotographic process according to claim 6 wherein sublimable leuco dyes are used as the sublimable dyes, said sublimable leuco dyes being (1) a sublimable leuco dye producing yellow color, (2) a sublimable leuco dye producing magenta color, and (3) a sublimable leuco dye producing cyan color.

* * * * *

UNITED STATES PATENT OFFICE
CERTIFICATE OF CORRECTION

Patent No. 4,121,932 Dated October 24, 1978

Inventor(s) Eisuke Ishida

It is certified that error appears in the above-identified patent and that said Letters Patent are hereby corrected as shown below:

Column 1, line 48: "essentialy" should be --essentially--.

Column 2, line 30: "methlanthraquinone" should be --methylanthraquinone--.

line 37: "nitropheynlazo" should be --nitrophenylazo--.

Column 5, line 43: "mixng" should be --mixing--.

line 65: "caly" should be --clay--.

line 67: "positivie" should be --positive--.

Column 6, line 35: "and" should be --an--.

UNITED STATES PATENT OFFICE

CERTIFICATE OF CORRECTION

Patent No. 4,121,932 Dated October 24, 1978

Inventor(s) Eisuke Ishida

It is certified that error appears in the above-identified patent and that said Letters Patent are hereby corrected as shown below:

Column 7, line 25: "40" should be --44--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*

UNITED STATES PATENT OFFICE

CERTIFICATE OF CORRECTION

Patent No. 4,121,932 Dated October 24, 1978

Inventor(s) Eisuke Ishida

It is certified that error appears in the above-identified patent and that said Letters Patent are hereby corrected as shown below:

Column 3, line 4: "0%" should be --2%--.

Signed and Sealed this

*Fourth* Day of *September 1979*

[SEAL]

*Attest:*

LUTRELLE F. PARKER

*Attesting Officer* *Acting Commissioner of Patents and Trademarks*